US006613726B1

(12) United States Patent
Gagliardi et al.

(10) Patent No.: US 6,613,726 B1
(45) Date of Patent: Sep. 2, 2003

(54) BLEACHING COMPOSITIONS

(76) Inventors: Leo Gagliardi, Procter & Gamble Italia S.p.A., Rome Technical Centre, Villa della Maglianella 65/t, I-00166 Rome (IT); Stefano Scialla, .Procter & Gamble Italia S.p.A., Rome Technical Centre, Via della Maglianella 65/t, I-00166 Rome (IT); Vincentius Henricus Adrianus Maria Van Spaendonk, Procter & Gamble Italia S.p.A., Rome Technical Centre, Via della Maglianella 65t, I-00166 Rome (IT); Silvia Zanazzi, Procter & Gamble Italia S.p.A., Rome Technical Centre, Via della Maglianella 65/t, I-00166 Rome (IT)

( * ) Notice: Subject to any disclaimer, the term of this patent is extended or adjusted under 35 U.S.C. 154(b) by 0 days.

(21) Appl. No.: 09/831,193

(22) PCT Filed: Nov. 10, 1999

(86) PCT No.: PCT/US99/26589

§ 371 (c)(1),
(2), (4) Date: May 7, 2001

(87) PCT Pub. No.: WO00/27990

PCT Pub. Date: May 18, 2000

(30) Foreign Application Priority Data

Nov. 10, 1998 (EP) ..... 98870248

(51) Int. Cl.[7] ..... C11D 3/39

(52) U.S. Cl. ..... 510/303; 510/313; 510/372; 510/376; 510/424; 510/427; 510/475; 8/137

(58) Field of Search ..... 510/303, 424, 510/372, 427, 376, 313, 475; 8/137

(56) References Cited

U.S. PATENT DOCUMENTS 6,087,312 A * 7/2000 Masotti et al. ..... 510/309
6,310,025 B1 * 10/2001 Del Duca et al. ..... 510/283

FOREIGN PATENT DOCUMENTS

EP 598 170 B1 5/1994
IT 0844302 * 5/1998

* cited by examiner

*Primary Examiner*—Gregory E. Webb
(74) *Attorney, Agent, or Firm*—James F. McBride; Kim W. Zerby; Steve W. Miller

(57) ABSTRACT

The present invention provides a stable composition in the form of an emulsion comprising a diacyl peroxide and a surfactant system.

14 Claims, No Drawings

BLEACHING COMPOSITIONS

CROSS REFERENCE TO RELATED APPLICATIONS

This application is an entry into the U.S. National Stage under 35 U.S.C. §371 of PCT International Application Serial No. PCT/US99/26589, filed Nov. 10, 1999, which claims priority to EP 98870248.6 filed Nov. 10, 1998.

TECHNICAL FIELD

The present invention relates to bleaching compositions. The compositions of the present invention are particularly useful for laundry bleaching.

BACKGROUND

Compositions for the bleaching of laundry have been extensively described in the art. Bleaching compositions can be classified into peroxide bleaching compositions and hypochlorite bleaching compositions. Peroxide bleaching compositions have the advantage over hypochlorite bleaching compositions in that they are generally considered as being somewhat safer to fabrics, specifically to colored fabrics. Peroxide compositions however have the inconvenience that they are often chemically unstable, which makes it difficult to formulate peroxide bleaching compositions which are sufficiently stable for sufficiently long periods of time to be commercialized. A possible solution to this problem consists in formulating compositions with a high level of peroxide, to extend the "effective" period of the composition. However, a potential drawback of this solution is that compositions may reach consumers which still comprise a high amount of peroxide, possibly causing skin irritation (e.g. itching) in contact with the peroxide composition. This irritation, specifically itching phenomenon is quite moderate and fully reversible, but does constitute potential discomfort for the user.

Furthermore peroxide species are in general poor bleaching agents at lower temperatures, so that it is required to formulate activated peroxide bleaching compositions if they are to be used across a wider range of temperatures. Activated bleaching compositions comprise a bleach activator, typically a peracid precursor, which will react in an aqueous medium with hydrogen peroxide to form the corresponding peracid. This peracid is an effective bleaching agent at lower temperatures.

It is thus an object of the present invention to formulate a peroxide bleaching composition which is stable, without having to resort to using higher amounts of peroxide, and which can be activated in a stable manner.

It is also an object of the present invention to formulate a bleaching composition with superior bleaching performance.

In response we have now found that this object can be met by formulating an aqueous emulsion as described herein.

Bleaching compositions formulated as emulsions have been disclosed in EP 598 170 and a co-pending patent application number EP-A-687 726. The compositions as described in '170 are emulsions comprising hydrogen peroxide in one phase and a hydrophobic liquid ingredient in the other phase. This hydrophobic liquid ingredient can be a peracid precursor. The compositions as described in '726 comprise at least two nonionic surfactants and benzoyl peroxide.

SUMMARY OF THE INVENTION

The present invention relates to a composition in the form of an aqueous emulsion and/or microemulsion comprising a diacyl peroxide and a surfactant system, wherein the surfactant system comprises at least one anionic surfactant and at least one nonionic surfactant.

DETAILED DESCRIPTION OF THE INVENTION

Aqueous Emulsion

The compositions according to the present invention are stable aqueous emulsions and/or microemulsions. By "stable emulsion" it is meant a liquid composition comprising polar and non polar components which does not macroscopically separate into distinct layers, upon standing for at least two weeks at 20° C., more preferably at least six months. The emulsion can alternatively be microemulsions. By "microemulsion" it is meant an emulsion that is thermodynamically stable.

The Applicants have found that diacyl peroxide (or DAP) is not stable in aqueous solution. However, when the DAP is formulated with a mixture of at least one anionic surfactant and at least one nonionic surfactant the stability of the DAP is improved. It is believed that this phenomenon exists because the surfactants form micelles in which the DAP is retained, thus protecting the DAP from decomposition. Moreover, it has additionally been found that the stability of the composition is improved even further when the composition comprises a hydrophobic solvent.

The compositions according to the present invention are aqueous. Accordingly, the compositions according to the present invention preferably comprise from 10% to 95% by weight of the total composition of water, preferably from 30% to 90%, most preferably from 60% to 85%. Deionized water is preferably used.

Diacyl Peroxide

The compositions of the present invention comprise a diacyl peroxide (or DAP). The DAP may be selected from the group consisting of dialiphatic peroxide, diaromatic peroxide, aliphatic-aromatic peroxide or mixtures thereof. Generally, the DAP has the general formula:

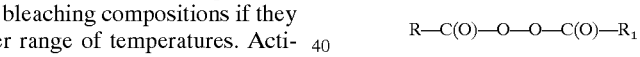

$$R—C(O)—O—O—C(O)—R_1$$

wherein R and $R_1$ can be the same or different and are selected from either aliphatic or aromatic groups having from 6 to 20 carbon atoms.

Where R and/or $R_1$ is an aliphatic group it may be branched, but is preferably linear. Preferred aliphatic groups have from 8 to 14 carbon atoms, most preferably 10 to 12 carbon atoms. Particularly, preferred dialiphatic peroxides include dioctanoyl peroxide, didecanoyl peroxide, dilauroyl peroxide, dimyristoyl peroxide or mixtures thereof. Dilauroyl peroxide is available from Akzo Nobel under the tradename Laurox®. Dodeconoy peroxide is availabe from Akzo Nobel under the tradename Perkadox SE 10.

An example of a suitable diaromatic peroxide is dibenzoyl peroxide. However for the purposes of the present invention although useful, these species are not preferred because they are more noticeably aggressive to colours, causing fabric colour loss.

Particulary preferred DAP's are aliphatic-aromatic peroxides wherein one of either R or R' is aliphatic and the other is aromatic. In these species the aromatic moiety is preferably benzoyl. In an alternative embodiment, the aromatic species may be a substituted benzoyl wherein the substituent is preferably an alkyl group having from 1 to 20 carbon atoms. The aliphatic moiety preferably comprises from 8 to 14 carbon atoms, more preferably from 10 to 12 carbon atoms and although it may be branched, it is preferably linear.

A particularly preferred aliphatic-aromatic peroxide is benzoyl-lauroyl peroxide. Typically the DAP is preferably at a level of from 0.01% to 20% by weight of the composition, more preferably 0.05% to 10%, most preferably 0.5% to 3%.

Surfactant

The compositions according to the present invention are emulsions of at least one anionic and at least one nonionic surfactant.

Suitable anionic surfactants for use in the compositions herein include water-soluble salts or acids of the formula $ROSO_3M$ wherein R preferably is a $C_8$–$C_{20}$ hydrocarbyl, preferably linear or branched alkyl having a C8–$C_{20}$ alkyl component, more preferably a $C_{10}$–$C_{14}$ linear or branched alkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Other suitable anionic surfactants for use herein are water-soluble salts or acids of the formula $RO(A)_mSO_3M$ wherein R is an unsubstituted $C_6$–$C_{24}$ linear or branched alkyl group having a $C_6$–$C_{24}$ alkyl component, preferably a $C_{10}$–$C_{20}$ linear or branched alkyl, more preferably $C_{12}$–$C_{18}$ linear or branched alkyl, A is an ethoxy or propoxy unit, m is greater than zero, typically between about 0.5 and about 30, more preferably between about 0.5 and about 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}$E(1.0) sulfate, $C_{12}$–$C_{18}$ alkyl polyethoxylate (2.25) sulfate, $C_{12}$–$C_{18}$E(2.25) sulfate, $C_{12}$–$C_{18}$ alkyl polyethoxylate (3.0) sulfate, $C_{12}$–$C_{18}$E(3.0) sulfate, and $C_{12}$–$C_{18}$ alkyl polyethoxylate (4.0) sulfate, $C_{12}$–$C_{18}$E (4.0) sulfate, wherein the counterion is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation.

Resin acids and hydrogenated resin acids -are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants for use herein also include acyl sarcosinate or mixtures thereof, in its acid and/or salt form, preferably long chain acyl sarcosinates having the following formula:

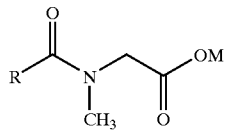

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

The most preferred anionic surfactants are selected from the group consisting of paraffin sulphonate, $C_{10-14}$ alkyl sulphates and mixtures thereof.

Suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Accordingly suitable nonionic synthetic surfactants include:

(i) The polyethylene oxide condensates of alkyl phenols, e.g., the condensation products of alkyl phenols having an alkyl group containing from 6 to 20 carbon atoms in either a straight chain or branched chain configuration, preferably from 8 to 12 carbon atoms, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane;

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000;

(iii) The condensation product of aliphatic alcohols having from 6 to 22 carbon atoms, in either straight chain or branched chain configuration, preferably from 8 to 18 carbon atoms, with from 2 to 35 moles of ethylene oxide, preferably from 4 to 25 and more preferably from 5 to 18 to make polyethoxylated alcohols. Example of this type of material are a coconut alcohol ethylene oxide condensate having from 5 to 18 moles of ethylene oxide per mole of coconut alcohol, the coconut alcohol fraction having from 9 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; specific example is tetradecyl dimethyl phosphine oxide;

(v) The condensation products of ethylene oxide with a hydrophobic base formed by the condensation of propylene oxide with propylene glycol; The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide.

Particularly suitable nonionic surfactants for use herein are capped nonionic ethoxylated surfactants according to the formula:

$$R_1(OR_2)_nOR_3$$

wherein $R_1$ is a $C_8$–$C_{18}$ linear or branched alkyl or alkenyl group, aryl group, alkaryl group, preferably, $R_1$ is a $C_{10}$–$C_{15}$ alkyl or alkenyl group, more preferably a $C_{10}$–$C_{15}$ alkyl group;

$R_2$ is a $C_2$–$C_{10}$ linear or branched alkyl group, preferably a $C_4$ group;

$R_3$ is a $C_1$–$C_{10}$ alkyl or alkenyl group, preferably a $C_1$–$C_5$ alkyl group, and n is an integer ranging in the range of from 1 to 20, preferably from 1 to 10, more preferably from 1 to 5;

or mixtures thereof.

These surfactants are commercially available from BASF under the trade name Plurafac®, from HOECHST under the trade name Genapol® or from ICI under the trade name Symperonic®. Preferred capped nonionic ethoxylated surfactant of the above formula are those commercially available under the tradename Genapol® L 2.5 NR from Hoechst, and Symperonic® LF/CS 1100 from ICI.

Other suitable nonionic surfactants for use herein include the amine oxides corresponding to the formula:

$$R\,R'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyidimethylamine oxide, N-octyldimethylamine oxide, N-decyidimethylamine oxide, N-dodecyl dimethylamine oxide, N-tetradecyidimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyidimethylamine oxide.

Other suitable nonionic surfactants for the purpose of the invention are the phosphine or sulfoxide surfactants of formula:

$$R\,R'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

Other suitable nonionic surfactants for use herein include a class of compounds which may be broadly defined as polymeric surfactants. Suitable polymeric surfactants include block-copolymers surfactants which comprise, preferably alternating hydrophilic and hydrophobic blocks such as the poly (alkylene oxide) copolymers. Examples of surfactants belonging to this class are the ethoxy/propoxy block copolymers usually referred to as Pluronics available from BASF.

Other suitable nonionic surfactants for the purpose of the invention include the alkyl polyglucosides (APG) which are condensation products of renewable raw materials (for example starch and natural oils) such as Glucopon from available from Henkel.

Other suitable nonionic surfactants for use herein also include sorbitan esters which are polyhydroxyl based surfactants for example those which are the condensation product of a fatty acid with the ring structure of sorbitan, which may is obtainable by dehydration of sorbitol. These surfactants are known under the Atlas trade name of Span.

The most preferred nonionic surfactants are selected from the group consisting of polyethoxylated alcohols, alkyl polyglucosides.

The ratio of anionic to nonionic surfactant is from 1:2 to 1:20, more preferably. 1:4 to 1:10.

Hydronhobic Solvent

In a particularly preferred embodiment of the present invention the composition also comprises a hydrophobic solvent. Where present the hydrophobic solvent is combined with the DAP prior to mixing the combination with the aqueous matrix comprising the surfactants. It has been found that the chemical and physical stability of a composition comprising hydrophobic solvent is even further improved versus when the hydrophobic solvent is not present.

A suitable hydrophobic solvent is an isoparafin admixture Having an initial boiling point of 218° C. and a dry point of 257° C., a flash point of 80.5° C., a specific gravity at 15.5° C. of 0.7865–0.7965, available by the tradename Isopar® M from Exxon and hydrophobic ester [(e.g. butylphalate)] (e.g., butylphthalate), n-hydrocarbons (e.g.,dodecan) and mixtures thereof.

PH

The pH of the compositions herein plays a role in the chemical stability of the composition. Accordingly, the compositions herein are preferably formulated at a pH of from 1 to 6, preferably 2 to 5. A variety of suitable means can be used for adjusting the pH of the compositions, including organic or inorganic acids.

Optional Ingredients

The compositions herein may comprise a variety of optional ingredients, for example other peroxygen bleach radical scavengers, chelants, additional surfactants, stabilisers, foam suppressers or boosters, soil suspending polymers, dye transfer inhibitors colourants and perfumes.

Peroxygen Bleach

Peroxygen bleach may be present as a preferred optional ingredient of the present invention. Suitable peroxygen bleaches to be used herein are hydrogen peroxide, water soluble sources thereof, or mixtures thereof. As used herein a hydrogen peroxide source refers to any compound that produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and colour while delivering excellent bleaching performance when used in any laundry application.

Typically, the compositions herein may comprise from 0.01% to 20%, preferably from 1% to 15% and more preferably from 1.5% to 10% by weight of the total composition of said peroxygen bleach.

Chelant

It may also be useful to include chelants in the compositions of the present invention. Suitable chelating agents to be used herein include chelating agents selected from the group of phosphonate chelating agents, amino carboxylate chelating agents, polyfunctionally-substituted aromatic chelating agents, and further chelating agents like glycine, salicylic acid, aspartic acid, glutamic acid, malonic acid, or mixtures thereof. Chelating agents when used, are typically present herein in amounts ranging from 0.001% to 5% by weight of the total composition and preferably from 0.05% to 2% by weight.

Suitable phosphonate chelating agents to be used herein may include ethydronic acid as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates. Such phosphonate chelating agents are commercially available from Monsanto under the trade name DEQUEST®.

The most preferred phosphonate chelating agent to be used herein is aminotri(methylene phosphonic acid), herein referred to as ATMP. Indeed, it has been found that the addition of ATMP, i.e. the compound of formula:

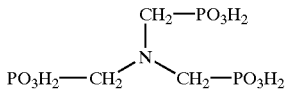

in a liquid composition of the present invention considerably reduces the damage otherwise associated with the pretreatment of fabrics with peroxygen bleach-containing compositions, especially those fabrics which contain metal ions, such as copper, iron, chromium, and manganese.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Another preferred chelating agent for use herein is of the formula:

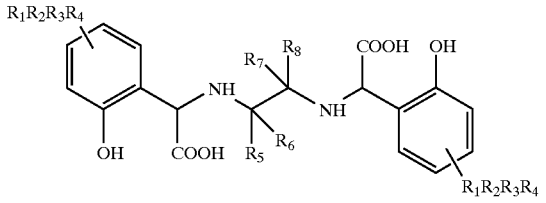

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Radical Scavenger

A preferred optional feature of the compositions herein a radical scavenger, which are beneficial to the stability of the compositions herein. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl4-hydroxy-5-t-butylphenyl)butane, n-propylgallate or mixtures thereof and highly preferred is di-tert-butyl hydroxy toluene. Radical scavengers when used, are typically present herein in amounts ranging from 0.001% to 2% by weight of the total composition and preferably from 0.001% to 0.5% by weight.

The presence of chelating agents, especially ATMP, and/or radical scavengers allows to contribute to the safety profile of the compositions of the present invention suitable for pretreating a soiled colored fabric upon prolonged contact times before washing said fabric. Radical scavengers, when used, are typically present herein in amounts ranging from 0.01% to 2% by weight of the total composition, preferably 0.01% to 0.2%.

Additional Surfactants

The compositions herein may further comprise other additional surfactants selected from nonionic, anionic, zwitterionic, cationic surfactants and mixtures thereof.

Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred zwitterionic detergent compounds have the formula:

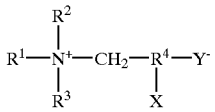

wherein R1 is an alkyl radical containing from 8 to 22 carbon atoms, R2 and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, R2 and R3 radicals is from 14 to 24 carbon atoms.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon's Detergents and Emulsifiers, North American Ed. 1980, incorporated herein by reference.

Cationic surfactants suitable for use in compositions of the present invention are those having a long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH_2CH_2$—, and mixtures thereof; each $R^4$ is selected from the group consisting of $C_1$–$C_4$ alkyl, benzyl ring structures formed by joining the two $R^4$ groups, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Quatemary ammonium surfactant suitable for the present invention has the formula (I):

Formula I

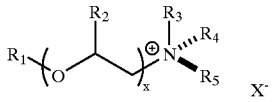

whereby R1 is a short chainlength alkyl (C6–C10)

y is 2–4, preferably 3.

whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula II, whereby $X^-$ is a counterion, preferably a halide, e.g. chloride or methylsulfate.

Formula II

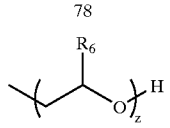

R6 is $C_1$–$C_4$ and z is 1 or 2.

Preferred quat ammonium surfactants are those as defined in formula I whereby $R_1$ is $C_8$, $C_{10}$ or mixtures thereof, x=o, $R_3$, $R_4$, $R_5$=$CH_3$.

Highly preferred cationic surfactants are the water-soluble quaternary ammonium compounds useful in the present composition having the formula:

$$R_1R_2R_3R_4N^+X^-(i)$$

wherein $R_1$ is $C_8$–$C_{16}$ alkyl, each of $R_2$, $R_3$ and $R_4$ is independently $C_1$–$C_4$ alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and the anion X may be selected from halide, methosulphate, acetate and phosphate ions.

Examples of suitable quaternary ammonium compounds of formulae (i) for use herein are:

coconut trimethyl ammonium chloride or bromide;

decyl triethyl ammonium chloride;

$C_{12}$–$C_{15}$ trimethyl ammonium chloride or bromide;

myristyl trimethyl ammonium methyl sulphate;

lauryl dimethyl benzyl ammonium chloride or bromide;

lauryl dimethyl $(ethenoxy)_4$ ammonium chloride or bromide;

choline esters (compounds of formula (i) wherein $R_1$ is

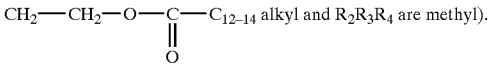

di-alkyl imidazolines

Other cationic surfactants useful herein are also described in U.S. Pat. No. 4,228,044, Cambre, issued Oct. 14, 1980 and in European Patent Application EP 000,224.

Foam Suppressers

The compositions according to the present invention may further comprise a foam suppressor such as 2-alkyl alkanol, or mixtures thereof, as an optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the α position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions of the present invention comprise up to 2% by weight of the total composition of a 2-alkyl alkanol, or mixtures thereof, preferably from 0.05% to 1.5% and more preferably from 0.1% to 0.8%.

Soil Suspending Polymer

The compositions according to the present invention may further comprise a soil suspending polyamine polymer or mixtures thereof, as optional ingredient. Any soil suspending polyamine polymer known to those skilled in the art may be used herein. Particularly suitable polyamine polymers for use herein are polyalkoxylated polyamines. Such materials can conveniently be represented as molecules of the empirical structures with repeating units:

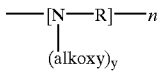

Amine form and

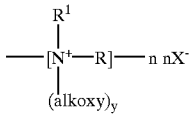

Quaternized form wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula:

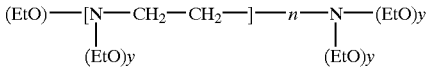

when y=2–30. Particularly preferred for use herein is an ethoxylated polyethylene amine, in particular ethoxylated. tetraethylenepentamine, and quaternized ethoxylated hexamethylene diamine.

Soil suspending polyamine polymers contribute to the benefits of the present invention, i.e., that when added on top of said diacyl peroxide, further improve the stain removal performance of a composition comprising them, especially under laundry pretreatment conditions, as described herein. Indeed, they allow to improve the stain removal performance on a variety of stains including greasy stains, enzymatic stains, clay/mud stains as well as on bleachable stains.

Typically, the compositions comprise up to 10% by weight of the total composition of such a soil suspending polyamine polymer or mixtures thereof, preferably from 0.1% to 5% and more preferably from 0.3% to 2%.

The compositions herein may also comprise other polymeric soil release agents known to those skilled in the art. Such polymeric soil release agents are characterized by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a co-polymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are fully described in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

If utilised, soil release agents will generally comprise from 0.01% to 10.0%, by weight, of the detergent compositions herein, typically from 0.1% to 5%, preferably from 0.2% to 3.0%.

Dye Transfer Inhibitor

The compositions of the present invention may also include one or more materials effective for inhibiting the transfer of dyes from one dyed surface to another during the cleaning process. Generally, such dye transfer inhibiting agents include polyvinyl pyrrolidone polymers, polyamine N-oxide polymers, co-polymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

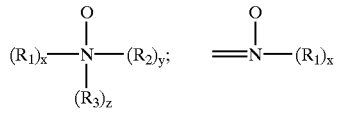

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block co-polymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate co-polymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". the most preferred polyamine N-oxide useful in the detergent compositions herein is poly(4-vinylpyridine-N-oxide) which as an average molecular weight of about 50,000 and an amine to amine N-oxide ratio of about 1:4.

Co-polymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI co-polymers typically have a molar ratio of N-vinylimidazole to N-vinylpyrrolidone from 1:1 to 0.2:1, more preferably from 0.8:1 to 0.3:1, most preferably from 0.6:1 to 0.4:1. These co-polymers can be either linear or branched.

The present invention compositions may also employ a polyvinylpyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from 500 to 100,000, preferably from 1,000 to 10,000. Preferably, the ratio of PEG to PVP on a ppm basis delivered in.-wash solutions is from 2:1 to 50:1, and more preferably from 3:1 to 10:1.

Suds Booster

If high sudsing is desired, suds boosters such. as $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, for example, 0.1%–2%, to provide additional suds and to enhance grease removal performance.

Brightener

Any optical brighteners, fluorescent whitening agents or other brightening or whitening agents known in the art can be incorporated in the instant compositions when they are designed for fabric treatment or laundering, at levels typically from about 0.05% to about 1.2%, by weight, of the detergent compositions herein. Commercial optical brighteners which may be useful in the present invention can be classified into subgroups, which include, but are not necessarily limited to, derivatives of stilbene, pyrazoline, coumarin, carboxylic acids, methinecyanines, dibenzothiophene-5,5-dioxide, azoles, 5- and 6-membered-ring heterocyclic brighteners, this list being illustrative and non-limiting. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-naphthol[1,2-d]triazoles; 4,4'-bis-(1,2,3-triazol-2-yl)-stil-benes; 4,4'-bis(styryl)bisphenyls; and the aminocoumarins. Specific examples of these brighteners include 4-methyl-7-diethyl-amino coumarin; 1,2-bis(-benzimidazol-2-yl)ethylene; 2,5-bis(benzoxazol-2-yl) thiophene; 2-styryl-napth-[1,2-d]oxazole; and 2-(stilbene4-yl)-2H-naphtho-[1,2-d]triazole. See also U.S. Pat. No. 3,646,015, issued Feb. 29, 1972, to Hamilton. Anionic brighteners are typically preferred herein.

Colourant

A preferred optional ingredient of the compositions described herein is a colourant. Colourants may be either dyes or pigments depending on their chemical structure. The colourants suitable for use herein are diacyl peroxide-stable i.e. they do not decompose a contact with diacyl peroxide.

Preferred stable colourants are selected from the group consisting of Pigment Green (CI 74260), Pigment Blue 15:3 (CI 74160) available from BASF, Pigment Blue 27 (CI 77510), copper (ii) pthalocyamine tetrasulphanic acid and mixtures thereof.

Process for Manufacture

The present invention further encompasses a process for the manufacture of the compositions described herein. The process according to the present invention comprises at least two steps:

In the first step, DAP is combined with a hydrophobic solvent. In the second step, the resulting mixture of the first step is combined with an aqueous matrix, comprising at least one anionic and one nonionic surfactant. The aqueous matrix preferably comprises other optional ingredients as well.

Process of Use

The composition of the present invention may be used as a laundry bleach to clean. Where the composition is used as a laundry bleach it can be added to the main wash cycle of a laundry washing machine alone or in addition to a conventional laundry detergent. However, it is preferably used as a pre-treatment wherein the composition is applied to a fabric, allowed to remain in contact with said fabric before being washed and/or rinsed off.

Said composition may remain in contact with said fabric, typically for a period of 1 minute to several hours, preferably 1 minute to 1 hour, more preferably 1 minute to 30 minutes, and most preferably 2 to 10 minutes. Optionally, when the fabric is soiled with encrusted stains/soils which otherwise would be relatively difficult to remove, said compositions may be rubbed and/or brushed more or less intensively, for example, by means of a sponge or a brush or simply by rubbing two pieces of fabric each against the other.

By "washing" it is to be understood herein to simply rinse the fabrics with water, or the fabrics may be washed with a conventional detergent composition comprising at least one surface active agent, this by the means of a washing machine or simply by hand.

By "in its neat form" it is to be understood that the liquid compositions are applied directly onto the fabrics to be pre-treated without undergoing any dilution, e.g., the compositions according to the present invention are applied as described herein.

According to the process of pretreating soiled fabrics of the present invention, the liquid compositions according to the present invention used in said process should preferably not be left to dry onto the fabrics. Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation contributes to generate peroxy-radicals which may cause color damage. Thus, not leaving the present liquid bleaching compositions to dry onto the fabrics, in the process of bleaching fabrics according to the present invention, contributes to a benefit according to the present invention, i.e., to reduce color damage when pretreating fabrics with liquid bleaching compositions.

EXAMPLES

The following compositions were made by mixing the listed ingredients in the listed proportions (weight %).

| Composition 1 | |
|---|---|
| Isopar M | 2% |
| Dibuthyl Phthalate | 0.5% |
| Dobanol 45-7 | 10% |
| NaPS | 1% |
| Didecanoyl Peroxide | 0.8% |
| H2O2 | 6.8% |
| Water and minors | to balance |
| pH | 3 |
| **Composition 2** | |
| Dobanol 23-6.5 | 5% |
| LAS | 1% |
| Isopar M | 1.5% |
| Benzoyl Lauroyl Peroxide | 2% |
| Water and minors | to balance |
| pH | 4 |

What is claimed is:

1. A bleaching composition comprising:

a) from 0.01% to 20% by weight, of a diacyl peroxide having the formula:

$$R—C(O)—O—O—C(O)—R_1$$

wherein R is $C_6$–$C_{20}$ aliphatic, and $R_1$ is $C_6$–$C_{20}$ aryl;

b) a surfactant system, wherein said system comprises:

i) one or more anionic surfactants;

ii) one or more ionic surfactants;

wherein the ratio of anionic to nonionic surfactants is from 1:2 to 1:20; and c) the balance carriers and other adjunct ingredients.

2. A composition according to claim 1 wherein said composition comprises from 0.05% to 10% by weight, of benzoyl lauroyl peroxide.

3. A composition according to claim 2 wherein said composition comprises from 0.5% to 3% by weight, of benzoyl lauroyl peroxide.

4. A composition according to claim 1 wherein said ratio of anionic to nonionic surfactant if from 1:4 to 1:10.

5. A composition according to claim 1 wherein said composition has a pH of from 1 to 6.

6. A composition according to claim 5 wherein said composition has a pH of from 2 to 5.

7. A composition according to claim 1 further comprising from 0.01% to 20% by weight, of a peroxygen bleach.

8. A composition according to claim 7 comprising from 0.05% to 20% by weight, of a peroxygen bleach.

9. A composition according to claim 7 wherein said peroxygen bleach is selected from the group consisting of percarbonates, persilicates, persulphates, perborates, hydrogen peroxide, and mixtures thereof.

10. A composition according to claim 1 further comprising from 0.001% to 5% by weight, of a chelating agent.

11. A composition according to claim 10 further comprising from 0.05% to 2% by weight, of a chelating agent.

12. A composition according to claim 1 wherein said composition has a pH of from 1 to 6 and comprises:

a) from 0.01% to 20% by weight, of a peroxygen bleach selected from the group consisting of percarbonates, persilicates, persulphates, perborates, hydrogen peroxide, and mixtures thereof; and b) from 0.001% to 5% by weight, of a chelating agent.

13. A bleaching composition comprising:

a) from 0.01% to 20% by weight, of a diacyl peroxide having the formula:

$$R—C(O)—O—O—C(O)—R_1$$

wherein R and $R_1$ are each independently $C_6$–$C_{20}$ aliphatic, $C_6$–$C_{20}$ aryl, and mixtures thereof, and R and $R_1$ are not identical;

b) a surfactant system, wherein said system comprises:

i) one or more anionic surfactants;

ii) one or more ionic surfactants;

wherein the ratio of anionic to nonionic surfactants is from 1:2 to 1:20: and c) the balance carriers and other adjunct ingredients.

14. A composition according to claim 13 wherein said composition has a pH of from 1 to 6 and comprises:

a) from 0.01% to 20% by weight, of a peroxygen bleach selected from the group consisting of percarbonates, persilicates, persulphates, perborates, hydrogen peroxide, and mixtures thereof; and b) from 0.001% to 5% by weight, of a chelating agent.

* * * * *